United States Patent [19]

Prange

[11] Patent Number: 4,540,017

[45] Date of Patent: Sep. 10, 1985

[54] HOSE FEEDER GUIDE APPARATUS

[76] Inventor: Charles J. Prange, 4875 Sellers Rd., Cridersville, Ohio 45806

[21] Appl. No.: 529,017

[22] Filed: Sep. 2, 1983

[51] Int. Cl.[3] ..... B65H 75/34

[52] U.S. Cl. ..... 137/355.12; 137/355.26; 242/86

[58] Field of Search ..... 137/355.12, 355.16, 137/355.17, 355.18, 355.19, 355.20, 355.21, 355.22, 355.23, 355.24, 355.25, 355.26; 242/86, 86.1; 73/158

[56] References Cited

U.S. PATENT DOCUMENTS

| | | | |
|---|---|---|---|
| 970,188 | 9/1910 | Crossing | 137/355.16 |
| 2,255,180 | 9/1941 | Marvel | 137/355.23 |
| 2,747,932 | 5/1956 | Volk | 137/355.16 |
| 3,774,630 | 11/1973 | Prange | 137/355.12 |
| 4,186,881 | 2/1980 | Long | 137/355.19 |
| 4,266,724 | 5/1981 | DiPalma et al. | 137/355.12 |
| 4,338,565 | 7/1982 | Hall | 73/158 |

*Primary Examiner*—A. Michael Chambers
*Assistant Examiner*—Sheri Novack
*Attorney, Agent, or Firm*—David O'Reilly

[57] ABSTRACT

A hose feeder guide apparatus for paying out or reeling in hose from a hose reel mounted in a compartment on a mobile sewer cleaning machine. The hose feeder guide apparatus is comprised of a guide roller and a tension roller mounted in tandem with the hose passing between. The tandem rollers are mounted on a pivotal bar which is swung side to side by a handle to evenly pay out or reel in a hose. The tension roller is supported on the bar by a frame which encloses and retains the hose between the two rollers comprised of a hinge on one side and a clasp on the other for opening the frame to permit removal or insertion of the hose between the two rollers. As the hose is payed out, a counter coupled to the guide roller indicates the number of feet the hose has been extended. An additional feature is the provision of means for adding accessories to provide additional support for the hose.

13 Claims, 7 Drawing Figures

HOSE FEEDER GUIDE APPARATUS

FIELD OF THE INVENTION

This invention relates to mobile sewer cleaning machines and more particularly relates to a hose feeder guide apparatus for paying out or reeling in a hose.

BACKGROUND OF THE INVENTION

In mobile sewer cleaning machines a heavy duty, high pressure hose on a reel is mounted in a compartment of the machine. Various tools may be attached to the end of the hose and are fed into sewer systems for sewer cleaning operations. To assist in paying out and reeling in the hose, hose guide systems have been devised. These are usually in the form of a grooved roller over which the hose passes. Improvements in this system were the addition of a pivotal mount so the grooved roller could be swung from side to side when paying out or reeling in the hose to provide even distribution. Further improvements comprised the addition of a second guide roller providing a nip between which the hose is passed. Among the disadvantages of these systems is the inability to remove or insert a hose with a cleaning tool attached because it would not pass between the nip of the roller guides. Additionally, the pivot mounting was supported at the opening to the hose reel compartment providing minimum leverage to a hose reeling operation. The pivot mount would permit the bar to swing to either side and could injure an operator by jerking to the side, pinning him between the hose feeder guide and the rear of the cleaning machine.

It is one object of the present invention to provide a hose feeder guide apparatus which is easier and safer to use.

Another object of the present invention is to provide a hose feeder guide apparatus having a guide roller and a tension roller mounted in tandem to retain the hose between the two rollers.

Still another object of the present invention is to provide means for easily inserting or removing a hose from between the guide roller and tension roller.

Yet another object of the present invention is to provide a hose feeder guide apparatus having means for indicating the length of hose which has been payed out.

Another object of the present invention is to provide an optional but preferred improvement of having means for adding hose guide and support accessories.

SUMMARY OF THE INVENTION

The purpose of the present invention is to provide a hose feeder guide apparatus for a mobile sewer cleaning machine with improved operation for paying out or reeling in sewer cleaning hose. The present invention is an improvement on present hose feeder guides and in particular is an improvement to the guide roller shown and described in U.S. Pat. No. 3,774,630 issued Nov. 27, 1973 to the same inventor as the device disclosed herein.

In the hose feeder guide apparatus of the present invention a guide roller and a tension roller are mounted in tandem on a pivotal bar. To provide leverage for easy control during paying out or reeling in a hose, these rollers are mounted on an elongate bar attached to a mobile sewer cleaning machine at a point behind the hose reel. The long arm extending beyond the reel provides great leverage for controlling the heavy, high pressure sewer cleaning hose during operation of the sewer cleaning machine.

The hose feeder guide apparatus has the guide roller and tension roller constructed and mounted so that the hose passes easily between the rollers and is retained by a swivel mounted frame supporting the tension roller on the pivotal lever arm. A handle attached to the arm permits the operator to easily move the arm from side to side when paying out or reeling in the hose. The tension roller frame is comprised of a hinge on one side and a clasp or latch on the other to open the space between the rollers for easy insertion or removal of the hose without the removal of sewer cleaning tools attached to the end of the hose. In operation, when reeling in a hose, the hose feeder guide apparatus is swung from side to side, evenly distributing the hose on the reel. When the hose is reeled in to the point where the tool comes close to the hose feeder guide apparatus, the latch or clasp is released, opening the two rollers, allowing easy removal of the hose to complete reeling the hose in.

The pivotal support bar or lever also passes through a slot formed at the opening to the hose reel compartment which controls the side to side movement, providing limit stops for safe operation. The limit stops limit the sideways travel of the lever arm to the width of the hose reel, preventing a sudden jerk on the hose from snapping the lever arm too far to either side to prevent injury to an operator.

Among the optional but preferred features of the invention are the addition of a counter coupled to the guide roller which counts the number of feet the hose has been extended into a sewer line. This provides an indication of the distance to a blockage or plug in the sewer line when encountered. Another optional feature is the addition of means for attaching accessories to aid in guiding and supporting hose during the reeling in or paying out operation. Among the accessories which could be added are an additional guide roller extending a substantial distance behind the mobile sewer cleaner to provide additional support for the hose or a guide roller which is at an angle to the main guide roller to deflect the hose at any angle desired.

The above and other features of the invention will be more fully understood from the following detailed description and the accompanying drawings in which:

DETAILED DESCRIPTION OF THE INVENTION

A mobile sewer cleaning machine is illustrated generally at 10. The mobile sewer cleaning machine may be chassis or trailer mounted and has a compartment 12 in which a hose reel 14 containing a high pressure, heavy duty hose 16 is mounted. In use, hose 16 is payed out with a sewer cleaning tool attached to the end of the hose and fed into a sewer line to be cleaned. As the hose is fed into the sewer line, water at extremely high pressure is pumped through the heavy duty hose to the sewer cleaning tool. Because hose 16 is stiff and relatively inflexible, it is difficult to manipulate. For this reason the hose feeding guide apparatus 18 has been provided. Hose guide systems have been previously conceived but generally they are a simple guide roller mounted on an arm pivotally attached to the rear of the sewer cleaning machine. Such an arrangement is difficult to use because it is difficult to keep the hose in the roller and the short pivot arm is not easily moved.

Figure 2:
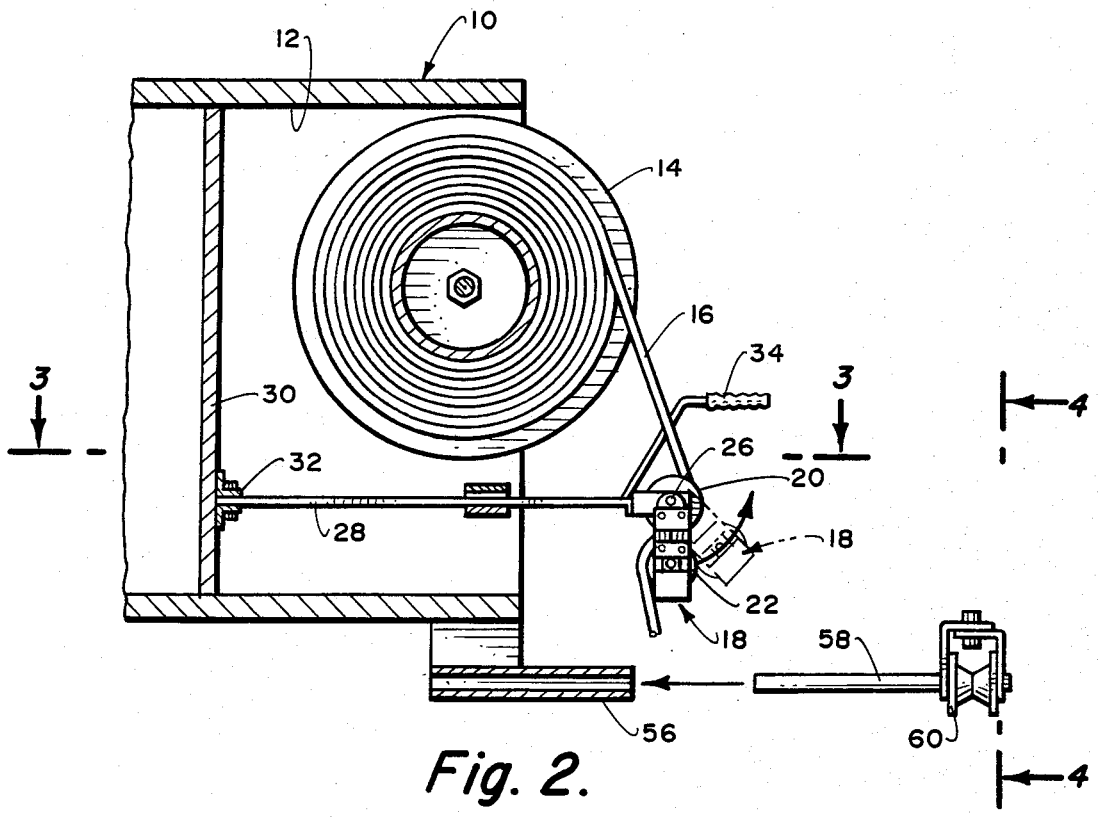
FIG. 2 is a partial section taken at 2—2 of FIG. 1.

Hose feeder guide apparatus 18 was conceived to provide improved ease of operation during paying out and reeling in of hose 16 while also retaining the hose in guide roller 20. The hose feeder guide apparatus is comprised of guide roller 20 and a swivel mounted tensioning idle roller 22 mounted in tandem with hose 16 passing between them as shown in FIG. 2. Hose 16 passes over guide roller 20 and under tension roller 22. Tension roller 22 serves to restrain or retain hose 16 between the two rollers with the hose in the groove of guide roller 20.

Tension roller 22 is mounted in a frame 24 pivotally attached to the axle 26 supporting guide roller 20. Thus tension roller 22 and frame 24 can swivel as indicated by the arrow, applying tension on hose 16 to maintain it in the groove of guide roller 20. Tension is applied by the weight of tension roller 22 on the hose with the addition of the spring bias force being possible if desired. However, tension roller 22 is preferably a solid, heavy steel roller whose weight alone applies adequate tension control.

Figure 3:
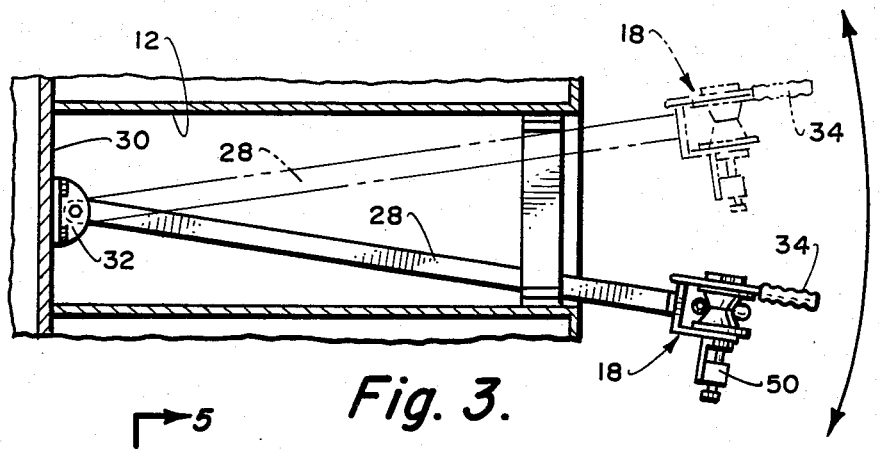
FIG. 3 is a partial section taken at 3—3 of FIG. 2.
Figure 4:
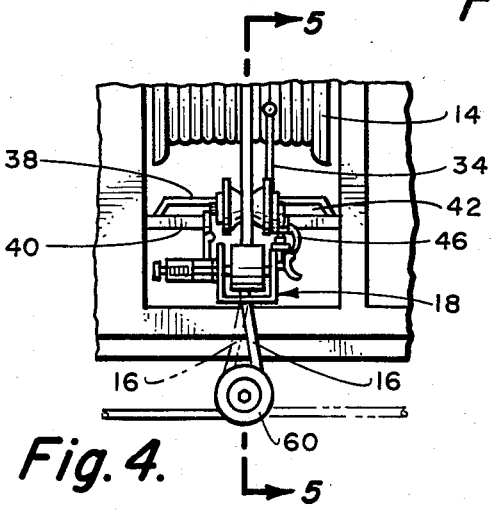
FIG. 4 is a partial section illustrating the optional accessory support system.

The tandem supported guide roller 20 and tension roller 22 are mounted on the end of a bar or lever arm 28 pivotally attached to a wall 30 at 32 at the rear of hose reel compartment 12 as shown in FIGS. 2 and 3. Since the pivot mount 32 is behind hose reel 14 it provides great leverage for controlling the distribution of hose 16 during paying out or reeling in operations. Handle 34 is mounted on the bar for ease of operation.

The movement of the hose feeder guide apparatus on lever arm 28 is illustrated in FIG. 3. The operator manipulates handle 34 to swing lever arm 28 from side to side as hose 16 is being reeled in, evenly distributing the hose back on the reel 14.

Figure 1:
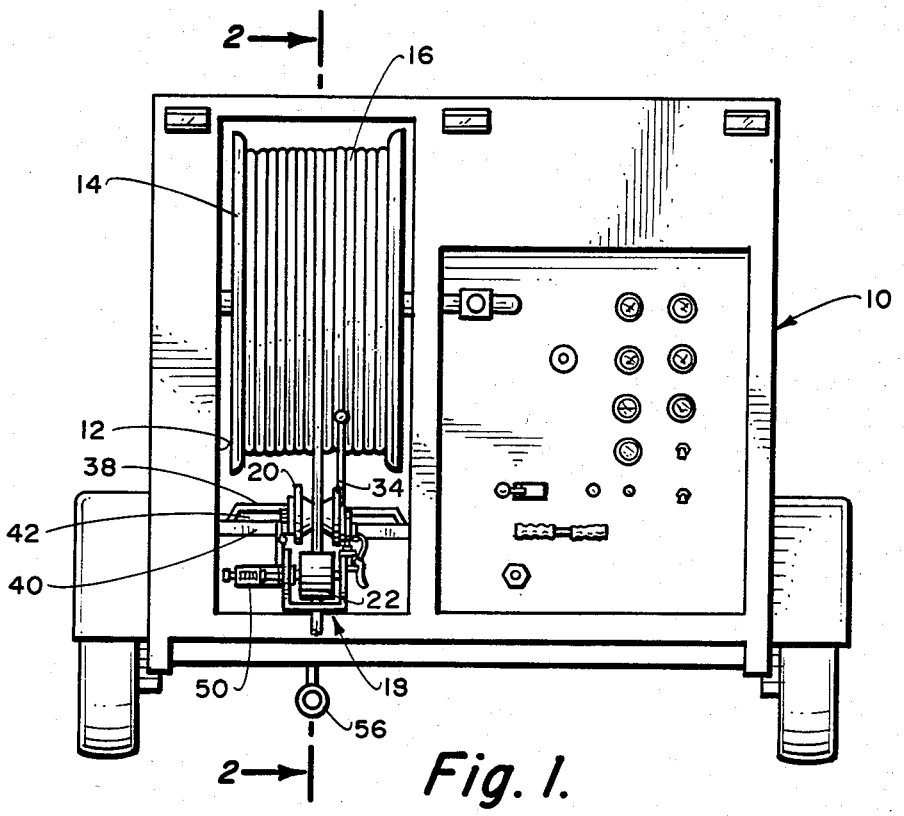
FIG. 1 is a rear elevation of a mobile sewer cleaning machine having a hose feeder guide apparatus according to the invention.

An additional feature is the use of a guide 36 for limiting the side to side motion of lever arm 28. Guide 36 is shown more clearly in FIG. 1 and is comprised of a bar 38 securely welded on beam 40 spanning the opening of reel compartment 12. Bar 38 forms a slot 42 providing limit stops approximately equal to the width of the hose reel 14. Slot 42 is sufficiently large to provide easy side to side movement but prevents hose feeder guide apparatus 18 from being jerked upwards or sideways beyond the limit stops. Thus an operator manipulating the hose feeder guide apparatus with handle 34 can stand out of the way to prevent injury by any quick jerk of the apparatus.

Figure 7:
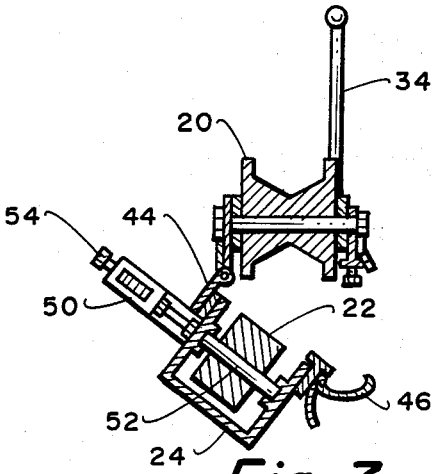
FIG. 7 is a partial sectional view illustrating the manner in which the rollers open for insertion or removal of a hose.
Figure 5:
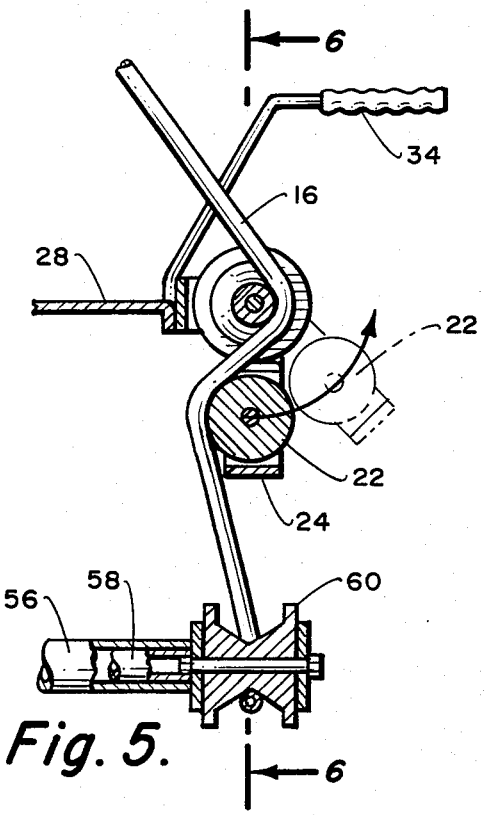
FIG. 5 is a partial sectional view illustrating the operation of the hose feeder guide apparatus.
Figure 6:
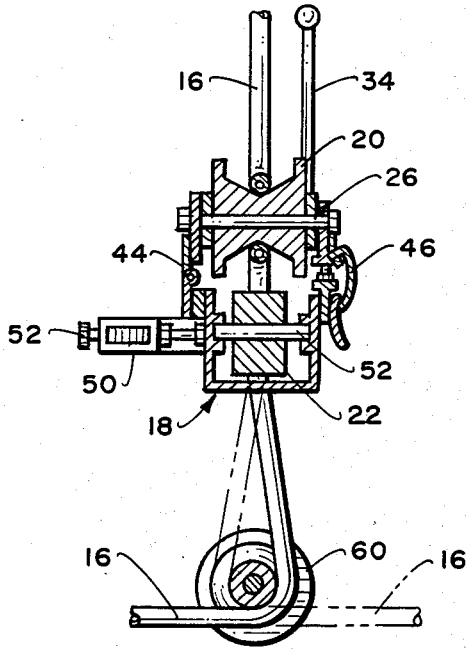
FIG. 6 is a sectional view taken at 6—6 of FIG. 5.

A disadvantage with prior hose guide systems using more than a single guide roller is that tools attached to the end of the hose had to be removed in order to position the hose between the guides. To avoid that possibility the hose feeder guide apparatus of the present invention has been constructed as illustrated in FIG. 7. Support frame 24 is attached to lever arm 28 by means of a hinge 44 on one side and a clasp or latch 46 on the other. To insert or remove a hose, latch 46 is opened as illustrated in FIG. 7, allowing tension roller 22 to drop away from guide roller 20, permitting the hose to be positioned in groove 21. Latch 46 is then closed to retain the hose between the two rollers. Thus, the hose can easily be inserted or removed by simply opening the two rollers, placing the hose between them and closing them without removing tools attached to the end of the hose.

An additional optional but preferred feature of the invention is the inclusion of a counting mechanism 50 which indicates the length of hose extended out from the mobile sewer cleaning apparatus. The counter is coupled to the axle 52 of tension roller 22 and counts the feet as the hose is extended. This can be helpful in determining a particular area of a sewer line where a blockage or a problem is encountered. With the distance indicated, a diagram of the sewer can indicate approximately where the problem has occurred. A reset button 54 is provided on the counter to reset it to zero after a hose has been reeled in.

Another useful optional but preferred feature of the invention is the addition of a socket (FIG. 2) 56 attached to the mobile sewer cleaning machine 10 beneath hose feeder guide apparatus 18. Socket 56 permits the addition of accessories for use with the hose feeder guide apparatus. One such accessory is illustrated in FIGS. 2 through 6. The accessory 58 is in the form of an additional guide roller 60 mounted at approximately right angles to guide roller 20 on the hose feeder guide apparatus. With the addition of roller 60 and hose 16 can be deflected at substantially right angles, if necessary. This is advantageous if the mobile sewer cleaning machine cannot be parked so that the hose can be fed directly rearward. Obviously, the roller 60 could be at different angles for deflecting the hose at various directions with respect to the hose feeder guide apparatus. Additionally, if the sewer entrance is a substantial distance from the back of the sewer cleaning machine, an extension can be mounted in socket 56 with a guide roller providing additional support for hose 16. Obviously with socket 56 as shown various accessory supports and guides could be added to assist in paying out or reeling in the hose.

In operation a tool is attached to the end of the hose and positioned between the guide roller 20 and the tension roller 22 by opening the rollers as illustrated in FIG. 7. The rollers would then be closed and the hose payed out to the opening of the sewer line. Optionally, if the sewer line opening is at an angle to the rear of the sewer cleaning machine, an accessory device 58 could be inserted in the socket to deflect the hose in the direction of the sewer line opening. As hose is fed out, counter 50 indicates the number of feet the hose has been extended from the back of the sewer cleaning machine. The operator can control smooth distribution of the hose by manipulating the hose feeder guide apparatus from side to side with handle 34.

When the sewer cleaning operation has been completed, the hose is reeled in with the operator moving the hose feeder guide apparatus from side to side with handle 34 to evenly wind the hose back on reel 14. Guide slot 42 limits the side to side movement of lever arm 28 during retrieval of the hose. Injury to the operator is minimized or prevented by guide slot 42 which limits the side to side movement to the width of hose reel 14. Thus the operator can stand out of the way of the hose feeder guide apparatus so that if it is jerked to one side or the other, it is unlikely to contact him.

Thus, there has been disclosed a hose feeder guide apparatus for a mobile sewer cleaning machine which is easy to operate and safe to use. It provides a guide roller and a tension roller to retain the hose during paying out or reeling in operations. Additionally, the mechanism supporting the tension roller opens to allow easy insertion or removal of a hose. A counter provides an indication of the number of feet of hose extended while a socket attached to the sewer cleaning machine permits attachment of a variety of support or control accessories.

This invention is not to be limited by the embodiment shown in the drawings and disclosed in the description which is given by way of example and not of limitation but only in accordance with the scope of the appended claims.

What is claimed is:

1. A hose feeder guide apparatus for a mobile sewer cleaning machine having a hose reel mounted in a hose reel compartment comprising:

hose guide roller means mounted on said machine adjacent an opening through which hose is payed out or reeled in;

pivot mount means pivotally mounting said hose guide roller means for side to side pivotal movement for evenly winding said hose onto said hose reel;

tension means for applying a tension to said hose; said tension means being mounted on said pivotally mounting means so that said hose passes between said guide roller and said tension means;

said tension means being constructed and arranged to allow said hose to be easily positioned between said tension means and said guide roller without removing tools attached to the end of said hose;

said tension means comprising a tension roller in juxtaposition to said hose guide roller means mounted on a frame swingably attached to said pivot mount means for said hose guide roller means for retaining said hose between said respective rollers;

opening means for opening said frame to insert or remove said hose from between said respective rollers;

whereby paying out or reeling in hose is readily controlled with said hose feeder guide apparatus.

2. Claim 1 including counting means coupled to said hose feeder guide apparatus for indicating the length of hose payed out.

3. Claim 1 in which said frame is formed of a hinge on one side and a clasp means on the other whereby said frame may be opened and closed to remove or insert said hose.

4. Claim 1 in which said pivot mount means pivotally mounting said hose guide roller means comprises an elongate arm; one end of said elongate arm being pivotally attached to a surface on said machine behind said hose reel.

5. Claim 4 including a pivot mount slot for controlling the side to side pivotal movement of said pivot mount means.

6. Claim 1 including an accessory socket mounted on said machine proximate said hose feeder guide apparatus for removably mounting hose guiding accessories.

7. Claim 6 in which an accessory mounted in said accessory socket comprises a second guide roller; said second guide roller constructed to deflect and guide said hose at an angle to the direction of said hose guide roller means.

8. Claim 6 in which said accessory mounted in said accessory comprises an extension having a second guide roller for providing additional support for said hose.

9. Claim 4 in which said tension means comprises a tension roller in juxtaposition to said hose guide roller means mounted on a frame swingably attached to said pivot mount means for said hose guide roller means for retaining said hose between said respective rollers; opening means for opening said frame to insert or remove said hose from between said respective rollers.

10. Claim 9 including a pivot mount slot for controlling the side to side pivotal movement of said pivot mount means.

11. Claim 10 including an accessory socket mounted on said machine proximate said hose feeder guide apparatus for removably mounting hose guiding accessories.

12. Claim 11 in which an accessory mounted in said accessory socket comprises a second guide roller; said second guide roller constructed to deflect and guide said hose at an angle to the direction of said hose guide roller means.

13. Claim 11 in which said accessory mounted in said accessory comprises an extension having a second guide roller for providing additional support for said hose.

* * * * *